US006924073B2

(12) United States Patent
Higuchi et al.

(10) Patent No.: US 6,924,073 B2
(45) Date of Patent: Aug. 2, 2005

(54) TONER FOR DEVELOPING ELECTROSTATIC LATENT IMAGE, TONER CARTRIDGE, DEVELOPER, DEVELOPER CARTRIDGE, IMAGE FORMING METHOD, AND IMAGE FORMING APPARATUS

(75) Inventors: Hiroto Higuchi, Numazu (JP); Mitsuo Aoki, Numazu (JP); Fumihiro Sasaki, Fuji (JP); Naohito Shimota, Shizuoka-ken (JP); Kumi Hasegawa, Numazu (JP); Bing Shu, Mishima (JP); Maiko Kondo, Numazu (JP); Shinya Nakayama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/329,538

(22) Filed: Dec. 27, 2002

(65) Prior Publication Data

US 2003/0165760 A1 Sep. 4, 2003

(30) Foreign Application Priority Data

Dec. 28, 2001 (JP) ..... 2001-401811

(51) Int. Cl.[7] ..... G03G 9/08

(52) U.S. Cl. ..... 430/108.4; 430/109.3; 430/109.4; 430/110.1; 430/120

(58) Field of Search ..... 430/120, 109.3, 430/108.4, 108.1, 109.4, 111.4, 110.4, 110.3, 110.1, 109.5

(56) References Cited

U.S. PATENT DOCUMENTS 2,297,691 A * 10/1942 Carlson ..... 430/55
4,645,729 A * 2/1987 Honda et al. ..... 430/126
4,810,612 A * 3/1989 Ueda et al. ..... 430/109.4
4,891,294 A * 1/1990 Noguchi ..... 430/108.1
4,957,840 A * 9/1990 Sakashita et al. ..... 430/110.4
5,814,429 A * 9/1998 Kawakami et al. ..... 430/109.4
6,060,201 A 5/2000 Kinoshita et al.
6,120,960 A 9/2000 Aoki et al.
6,183,926 B1 * 2/2001 Kuroda et al. ..... 430/110.4
6,221,549 B1 4/2001 Emoto et al.
6,228,550 B1 5/2001 Matsuda et al.
6,255,028 B1 7/2001 Hasegawa et al.
6,303,257 B1 10/2001 Hasegawa et al.
6,335,137 B1 1/2002 Suzuki et al.
6,403,275 B1 6/2002 Kuramoto et al.
6,432,590 B1 8/2002 Ueda et al.
6,468,706 B2 10/2002 Matsuda et al.
6,492,083 B1 * 12/2002 Livengood et al. ..... 430/108.4

OTHER PUBLICATIONS

U.S. Appl. No. 10/806,104, filed Mar. 23, 2004, Suzuki et al.
U.S. Appl. No. 10/800,636, filed Mar. 16, 2004, Hasegawa et al.
U.S. Appl. No. 10/759,029, filed Jan. 20, 2004, Sugiura et al.
U.S. Appl. No. 10/759,197, filed Jan. 20, 2004, Emoto et al.
U.S. Appl. No. 10/760,452, filed Jan. 21, 2004, Higuchi et al.
U.S. Appl. No. 10/793,320, filed Mar. 5, 2004, Higuchi et al.
U.S. Appl. No. 10/666,254, filed Sep. 22, 2003, Kondo et al.
U.S. Appl. No. 10/712,026, filed Nov. 14, 2003, Tomita et al.
U.S. Appl. No. 10/724,260, filed Dec. 1, 2003, Emoto et al.
U.S. Appl. No. 10/726,669, filed Dec. 4, 2003, Kotsugai et al.
U.S. Appl. No. 10/650,754, filed Aug. 29, 2003, Koichi et al.
U.S. Appl. No. 10/615,770, filed Jul. 10, 2003, Mochizuki et al.
U.S. Appl. No. 10/960,084, filed Oct. 8, 2004, Yamada et al.
U.S. Appl. No. 10/959,663, filed Oct. 7, 2004, Sugiura et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A toner for developing an electrostatic latent image, comprising a colorant, a releasing agent and a binder resin, wherein said binder resin comprises a first, non-linear resin, a second, linear resin, and a modified wax comprising a wax moiety and a vinyl polymer moiety having an ester group content of 8 to 30% by weight based on the weight of the vinyl polymer moiety.

29 Claims, 2 Drawing Sheets

TONER FOR DEVELOPING ELECTROSTATIC LATENT IMAGE, TONER CARTRIDGE, DEVELOPER, DEVELOPER CARTRIDGE, IMAGE FORMING METHOD, AND IMAGE FORMING APPARATUS

BACKGROUND OF THE INVENTION

1. Field of the Invention

This invention relates to a toner for developing an electrostatic latent image formed by electrophotography, electrostatic recording or electrostatic printing and to a toner cartridge containing the toner. The present invention is also directed to a developer containing the above toner, to a developer cartridge containing the developer, to an image forming method using the toner, and to an image forming apparatus using the toner.

2. Discussion of the Background

Various electrophotographic image forming methods have been disclosed in, for example, U.S. Pat. No. 2,297,691, Japanese Patent Publications Nos. 49-23910 and 43-24748. The methods typically include the following steps:

(1) the surface of an image bearable member such as a photoconductor is charged (charging process);
(2) the image bearable member is exposed to light to form an electrostatic latent image thereon (latent image forming process);
(3) the latent image is developed with an electrophotographic toner to form a toner image on the image bearable member (developing process);
(4) the toner image is transferred onto a receiving material (transferring process); and
(5) the toner image on the receiving material is fixed by application of heat, pressure, solvent vapor, or combination thereof to prepare a copy image (fixing process).

The method for developing electrostatic latent images is broadly classified into the following methods:

(1) a wet developing method using a liquid developer including a fine color pigment or dye dispersed in a liquid; and
(2) a dry developing method such as a cascade method, a magnetic brush method and a powder cloud method, which uses a developer (toner) including a colorant such as carbon black dispersed in a binder resin. Recently the dry developing methods are widely used.

In order to obtain a high quality image, it is important that a latent image on a latent image bearing member should be precisely developed with a toner under any given conditions. Typical characteristics of a toner required to provide high quality images include preservability (anti-blocking property), moveability, developing efficiency, transferability, chargeability and fixability.

As for fixing method in electrophotography, a heat. roller fixing method has been typically used because of good energy efficiency. However, the heat roller fixing method has a drawback because an offset phenomenon tends to occur. Namely, when a toner image is fixed, part of the toner image adheres to the heat roller and is transferred on a copy paper, resulting in formation of an undesired image.

In an attempt to solve such an offset problem, a method in which a releasing agent such as wax is included in a toner has been proposed. For, example, Japanese Laid-Open Patent Publications Nos. 51-143333, 57-148752, 58-97056 and 60-247250 disclosed the use of a solid silicone varnish, a higher fatty acid, a higher alcohol, a wax, etc. as a releasing agent.

However, when such a releasing agent is included in a toner, a filming problem tends to occur. Thus, the releasing agent is separated from the toner when developing processes are performed. The thus formed free releasing agent adheres to a photoconductor and a developing sleeve. The thus formed film of the releasing agent gradually grows as copying processes are repeated, resulting in formation of a white streak on a half tone image. Therefore, a toner including a releasing agent is required to solve the offset phenomenon and filming problem at the same time. In other words, in order to produce images having good image qualities for a long period of time, it is necessary to improve toners while paying attention to the releasing agent therein.

Currently, a need for high quality images increases more and more in the market. Satisfactory images cannot be produced by conventional toners, which typically have a volume average particle diameter of from 10 to 15 $\mu$m and, therefore, a need exists for a toner having a smaller particle diameter. However, when the particle diameter of a toner becomes small, the releasing agent included in the toner is easily separated from the toner upon being subjected to stresses, etc. In particular, when the toner is prepared by a pulverization method, stresses are predominantly exerted on the releasing agent which typically has a narrow molecular weight distribution and is brittle and, therefore, the releasing agent is apt to be present on outer surfaces of the toner particles or to be present as fine powders in the resultant toner.

Therefore, when a toner having a small particle diameter is used to produce high quality images, the filming problem is most likely to occur. To cope with this problem, Japanese Published Examined Patent Applications No. S52-3304 and No. H07-82255 propose a toner in which a polyolefin releasing agent (such as low molecular weight polyethylene, low molecular weight polypropylene) or a styrene-grafted polyolefin releasing agent is used in conjunction with a styrene resin binder resin. Since the styrene resin is poor in low temperature fixability, however, the proposed toner fails to meet with recent demand for an energy saving image forming system.

With respect to the low temperature fixability of a toner, a polyester resin is known to be suited as a binder resin therefor. However, the a releasing agent is not sufficiently dispersed in a polyester binder resin and, hence, hot offset problem is apt to occur.

Thus, in an attempt to improve low temperature fixability of toner, there are proposals to use two polyester resins having different properties as a binder resin. For example, Japanese Laid-Open Patent Publication No. S60-90344 proposes a method in which a non-linear polyester resin is used in combination with a linear polyester resin. Japanese Laid-Open Patent Publication No. S64-15755 proposes a method in which a crosslinkable polyester having a glass transition temperature (Tg) not lower than 50° C. and a softening point not higher than 200° C. is used in combination with a linear polyester resin having a softening point not higher than 150° C. and a weight average molecular weight (MW) of from 3,000 to 50,000. Japanese Laid-Open Patent Publication No. H02-82267 discloses a method in which a non-linear polyester polymer having a weight average molecular weight not less than 5,000 and a variance ratio (MW/MN) not less than 20 is used in combination with a non-linear polyester polymer having a weight average molecular weight of from 1,000 to 5,000 and a variance ratio not less than 4. Japanese Laid-Open Patent Publication No. H03-229264 proposes a method in which an organic metal compound is used in conjunction with a binder resin composed of a linear polyester resin having an acid value of from 5 to 60 and a non-linear polyester resin having an acid value less than 5. Further, Japanese Laid-Open Patent Publication No. H03-41470 proposes a method in which two kinds of saturated polyester resins having different acid values (the acid value of one polyester resin is at least 1.5 times as great as that of the other polyester resin) are used in combination.

In these methods, it is intended to achieve both low temperature fixability and high hot offset resistance by using a mixture of a non-crosslinkable resin with a crosslinkable resin. However, the blended resins have good compatibility (i.e., the resins can be mixed well with each other) and, therefore, the kneaded toner composition cannot be easily pulverized, resulting in poor productivity and high manufacturing costs.

In addition, toners in which a polyester resin having good fixability is mixed with a styrene-acrylic resin having good pulverizability are disclosed in Japanese Laid-Open Patent Publications No. S49-6931 and No. S54-11424. Since the polyester resins typically have poor compatibility with styrene-acrylic resins, however, they are unevenly dispersed in a toner when simply mixed mechanically. Therefore, a coloring agent such as carbon black and a charge controlling agent are poorly dispersed in the toner, resulting in occurrence of background stains in the toner images.

SUMMARY OF THE INVENTION

It is, therefore, an object of the present invention to provide a toner which can exhibit both good low temperature fixability and high resistance to filming.

Another object of the present invention is to provide a toner which can be used for a long period of time without causing filming of an image bearing member, etc. and without causing a hot offset problem even when the toner is subjected to mechanical and heat stresses.

It is a further object of the present invention to provide a toner which can produce high quality images having good fine line reproducibility and uniform image density without causing background stains.

It is yet a further object of the present invention is to provide a toner having a good high temperature preservability.

A still further object of the present invention is to provide an image forming method and an image forming apparatus by which good images can be produced at a low fixing temperature without causing a filming problem and a hot offset problem.

In accordance with one aspect of the present invention, there is provided a toner for developing an electrostatic latent image, comprising a colorant, a releasing agent and a binder resin, wherein said binder resin comprises a first, non-linear resin, a second, linear resin, and a modified wax comprising a wax moiety and a vinyl polymer moiety having an ester group content of 8 to 30% by weight based on the weight of the vinyl polymer moiety.

In another aspect, the present invention provides a toner cartridge containing the above toner.

The present invention also provides a two-component developer comprising the above toner, and a carrier.

In a further aspect, the present invention provides a cartridge containing the above two-component developer.

The present invention further provides an image forming method, comprising developing an electrostatic latent image on an latent image-bearing member with the above toner.

The present invention further provides an image forming apparatus comprising an latent image-bearing member, and a developing unit containing the above toner and configured to develop the electrostatic latent image on said latent image-bearing member with said toner.

BRIEF DESCRIPTION OF THE DRAWING

Other objects, features and advantages of the present invention will become apparent from the detailed description of the preferred embodiments which follows, when considered in light of the accompanying drawings, in which.

DETAILED DESCRIPTION OF THE PREFERRED EMBODIMENTS OF THE INVENTION

Figure 1:
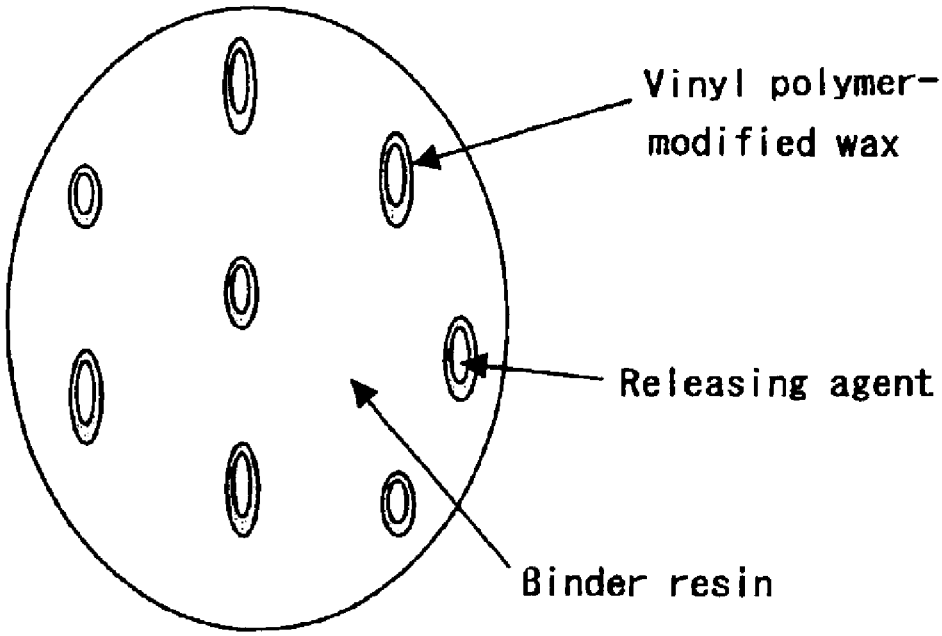
FIG. 1 is a schematic illustration of a TEM pattern of a cross-section of a toner particle according to the present invention.

A toner for developing an electrostatic latent image according to the present invention comprises a colorant, a releasing agent and a binder resin. The binder resin comprises (A) a first, non-linear resin, (B) a second, linear resin, (C) optionally, a third, hybrid resin, and (D) a modified wax. These components of the binder resins will be first described in detail below.

The non-linear resin and liner resin may be polymers prepared by condensation polymerization such as polyester resins, polyester-polyamide resins and polyamide resins.

Polyesters may be obtained by polycondensation of at least one polyol and at least one polyacid. The polyol may be a diol or a tri- or more polyhydric alcohol. As the diol to be used for the preparation of the polyester, any diol employed conventionally for the preparation of polyester resins can be employed. Preferred examples include alkylene glycols having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol; alkylene ether glycols, such as diethylene glycol, triethylene glycol, dipropylene glycol, polyethylene glycol, polypropylene glycol, and polytetramethylene glycol; alicyclic diols having 6 to 30 carbon atoms, such as 1,4-cyclohexane dimethanol and hydrogenated bisphenol A; bisphenols, such as bisphenol A, bisphenol F and bispbenol S; adducts of the above-mentioned bisphenol with 2 to 8 moles of an alkylene oxide, such as ethylene oxide, propylene oxide, or butylene oxide. Examples of the polyol having three or more hydroxyl groups include polyhydric aliphatic alcohols having 3 to 20 carbon atoms, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, and trimethylolpropane.

The polyacid may be a dicarboxylic acid, tri- or more polybasic carboxylic acid or a mixture thereof. As the dicarboxylic acid to be used for the preparation of the base polyester, any dicarboxylic acid conventionally used for the preparation of a polyester resin can be employed. Preferred examples of dicarboxylic acids include maleic acid, fumaric acid, succinic acid, adipic acid, sebacic acid, malonic acid, azelaic acid, mesaconic acid, citraconic acid, glutaconic acid, cyclohexanedicarboxylic acid, phthalic acid, isophthalic acid, terephthalic acid, toluenedicarboxylic acid, naphthalenedicarboxylic acid, succinic acid, adipic acid, sebacic acid, malonic acid, lower alkyl esters thereof, and anhydrides thereof. These dicarboxylic acids may have one or more saturated or unsaturated hydrocarbyl groups having 3–22 carbon atoms. Specific examples of the polycarboxylic acid having three or more carboxyl groups include 1,2,4-benzenetricarboxylic acid, 1,2,5-benzenetricarboxylic acid, 2,5-7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Enbol trimer acid, linoleic acid dimer, anhydrides thereof and lower alkyl esters thereof.

Suitable monomers for use in the polyester-polyamide resins and polyamide resins include polyamines such as ethylenediamine, pentamethylenediamine, hexamethylenediamine, phenylenediamine and triethylenetetramine; aminocarboxylic acids such as 6-aminocaproic acid and ϵ-caprolactam.

The polyester resins, polyester-polyamide resins and polyamide resins for use in the present invention preferably have a glass transition temperature of at least 55° C., more preferably at least 57° C.

Preferably, each of the non-linear resin and liner resin has at least 50 mole %, more preferably at least 70 mole %, still more preferably at least 85 mole %, yet more preferably at least 90 mole %, most preferably at least 95 mole %, of ester units, based on a total moles of the monomer units constituting respective non-linear resin and liner resin.

The non-linear resin has a crosslinked structure, while the linear resin has substantially no crosslinked structure. The linear resin can be prepared for example, by performing polymerization using a monomer having three or more reactive groups, such as tri- or more polyhydric alcohols and/or tri- or more polycarboxylic acids.

Since the non-linear resin effective to provide improved hot offset resistance is used as a binder resin in conjunction with the linear resin effective to provide improved low temperature fixability, the toner containing the binder resin exhibits good hot offset resistance and low temperature fixability. Especially when the non-linear resin and linear resin are of the same kind of polymer, the resulting toner has significantly wide temperature range in which fixation of toner images can be suitably performed.

The binder resin may optionally contain a hybrid resin including a first polymer unit obtainable by condensation polymerization, and a second polymer unit obtainable by addition polymerization. Such a hybrid resin may be prepared by a method in which a mixture containing monomer components for the first polymer unit and monomer components for the second polymer unit are subjected to polymerization conditions so that the condensation polymerization and the addition polymerization proceed at the same time. Alternatively, the condensation polymerization of monomers for the first polymer unit may be preceded or followed by the addition polymerization of monomers for the second polymer unit.

Monomers for the first polymer unit obtainable by condensation polymerization are similar to those described above with reference to the non-linear and linear resins.

Monomers for use in the second polymer unit obtainable by addition polymerization include styrene or its homologue such as styrene, o-methylstyrene, m-methylstyrene, p-methylstyrene, α-methylstyrene, p-ethylstyrene, vinylnaphthalene; ethylenically unsaturated olefins such as ethylene, propylene, butylene and isobutylene; vinyl esters such as vinyl chloride, vinyl bromide, vinyl acetate and vinyl formate; ethylene type monocarboxylic acids and their esters such as acrylic acid, methyl acrylate, ethyl acrylate, n-propyl acrylate, isopropyl acrylate, tert-butyl acrylate, amyl acrylate, methacrylic acid, methyl methacrylate, ethyl methacrylate, n-propyl methacrylate, isopropyl methacrylate, tert-butyl methacrylate, amyl methacrylate, stearyl methacrylate, methoxy ethyl methacrylate, glycidyl methacrylate, phenyl methacrylate, dimethylaminoethyl methacrylate and diethylaminoethyl methacrylate; ethylene type monocarboxylic acid substitution compounds such as acrylonitrile, methacrylonitrile and acrylamide; ethylene type dicarboxylic acids and their substitution compounds such as dimethyl maleate; and vinyl ketones such as vinyl methyl ketone.

In addition, a crosslinking agent can be added when addition polymerization is performed. Specific examples of the crosslinking agents for use in the addition polymerization include known crosslinking agents such as divinyl benzene, divinyl naphthalene, polyethyleneglycol dimethacrylate, diethyleneglycol dimethacrylate, triethyleneglycol diacrylate, diprophleneglycol dimethacryalte, polypropyleneglycol dimethacrylate, and diallyl phthalate.

The amount of the crosslinking agent is generally 0.05 to 15 parts by weight, preferably from 0.1 to 10 parts by weight, per 100 parts by weight of monomers used for reasons of providing suitable crosslinkages while maintaining suitable fusibility during fixation.

For the effective radical polymerization of the addition-polymerizable monomer, a polymerization initiator is preferably used. Examples of the initiator include azo type or diazo type initiators such as 2,2-azobis(2,4-dimethylvaleronitrile) and 2,2-azobisisobutylonitrile, or peroxide polymerization initiators such as benzoyl peroxide, methyl ethyl ketone peroxide and 2,4-dichlorobenzoyl peroxide. These initiators can be used in combination to control the molecular weight and molecular weight distribution of the resultant polymer. The addition amount of the initiator is from 0.05 to 15 parts by weight, and more preferably from 0.5 to 10 parts by weight, per 100 parts by weight of the monomer used.

It is important that a double-reactive monomer which can react with the monomers for the first polymer unit and the second polymer unit should be additionally used in order for the both polymer units to be bound to each other. Specific examples of such double-reactive monomers include fumaric acid, acrylic acid, methacrylic acid, maleic acid and dimethyl fumarate. The amount of the double-reactive monomer is from 1 to 25 parts by weight, preferably from 2 to 10 parts by weight, per 100 parts by weight of the total monomers for the first and second polymer units.

One suitable method for the production of the hybrid resin is as follows. A mixture of a condensation-polymerizable monomer for, for example, a polyester resin and a double-reactive monomer is contained in a reactor, to which a mixture of addition-polymerizable monomers for, for example, a vinyl resin and a polymerization initiator is added dropwise to complete the radical polymerization reaction of the addition-polymerizable monomers for the vinyl resin. Then, the temperature of the mixture is increased to complete the condensation polymerization reaction resulting in formation of the polyester resin. By performing the two different polymerizations independently in the reactor, the two different resins can be effectively dispersed.

It is preferred that the non-linear resin, linear resin and hybrid resin contain the same kind of polymer unit, such as a polyester unit, for reasons of improved dispersibility of a releasing agent in the binder resin, wide temperature range for fixation, improved anti-filming property, good heat resisting preservability and reduction of background stains.

The amounts of the non-linear resin, linear resin and hybrid resin are preferably 30 to 70 parts by weight, 30 to 70 parts by weight and 5 to 30 parts by weight, respectively, per 100 parts by weight of a total amount of the non-linear resin, linear resin and hybrid resin.

It is preferred that the non-linear resin, linear resin and hybrid resin have softening points and glass transition temperatures satisfying the following conditions (1) to (3):

$$TM1>TM3>TM2 \quad (1)$$

$$-10^\circ\ C.<(TG1-TG2)<10^\circ\ C. \quad (2)$$

$$30^\circ\ C.\leqq(TM1-TM2)\leqq 60^\circ\ C. \quad (3)$$

more preferably $$-7^\circ\ C.<(TG1-TG2)<7^\circ\ C.$$

$$35^\circ\ C.\leqq(TM1-TM2)\leqq 55^\circ\ C.,$$

in which TM1, TM2 and TM3 represent the softening points of the non-linear resin, linear resin and hybrid resin, respectively, and TG1, TG2 and TG3 represent the glass transition temperatures of the non-linear resin, linear resin and hybrid resin, respectively, for reasons of wider temperature range in which the toner can be suitably fixed and better pulverizability and dispersibility during preparation of the toner. In particular, when the above condition (1) is met, background stains can be reduced because the hybrid resin can be uniformly dispersed in the non-linear and linear resins. The condition (2) is effective in improving compatibility of the resins during kneading and, hence, in reducing background stains. The condition (3) permits fixation of the toner in a wider temperature range.

The term "softening point" as used herein is intended to refer to $F_{1/2}$ temperature measured in accordance with JIS K72101 using a commercially available flow tester of capillary type, "CFT-500" (Trademark), made by Shimadzu Corporation. A sample of the resin (1 $cm^3$) is placed in a cylinder of the tester provided with a small orifice with a diameter of 1 mm. The temperature of the sample is increased at a rate of 6° C./min while applying a pressure of 20 $kg/cm^2$ to the resin sample to permit the resin sample to flow out through orifice. The height of the sample resin in the cylinder, which decreases as the resin flows through the orifice, is plotted against the temperature. The temperature at which the height of the resin sample in the cylinder has decreased to ½ of the original height (½ of the height from the flow-out initiation point to the flow-out completion point) represents the softening point of the sample resin.

The "glass transition temperature" as used herein is measured using a differential scanning calorimeter DSC-60 manufactured by Shimadzu Corporation as follows:

A resin sample is heated from room temperature to 200° C. at a heating speed of 10° C./min, and then cooled at a cooling speed of 10° C./min to room temperature. The sample is then measured for DCS curve at a heating speed of 10° C./min. The glass transition temperature (Tg) as used herein is intended to refer to a temperature at the intersection of the base line and a tangentially extrapolated line drawn from such a point on the DSC curve on the lower temperature side of the endothermic peak (i.e. between the apex of the endothermic peak and a point at which the endothermic peak starts separating from the base line) that the gradient of the tangential line relative to the base line is maximum.

The non-linear resin preferably has an acid value of 20 to 70 mg KOH/g and the linear resin preferably has an acid value of 7 to 70 mg KOH/g, for reasons of improved low temperature fixability (probably due to improved compatibility between the toner and a paper on which toner images are fixed) and better storage stability (probably due to improved stability against moisture in the environment).

One of the important features of the present invention resides in that a modified wax is contained in the toner. It has been found that the modified wax is suitably dispersed in the binder resin and that a suitable amount of the releasing agent is contained in the modified wax. As a consequence of this expedience, the releasing agent is less likely to be exposed on outer surfaces of the toner particles. Yet, the releasing agent is located adjacent to outer surfaces of the toner particles and can be exuded therefrom when heated and/or pressed by fixing rollers during image fixation stage so that necessary releasing effect may be attained.

The modified wax includes a wax moiety and a vinyl polymer moiety having an ester group content of 8 to 30% by weight based on the weight of the vinyl polymer moiety. It is preferred that at least part of the wax moiety constitutes the main chain of the modified wax with the vinyl polymer moiety grafting thereon or copolymerizing therewith to constitute side chain or chains for reasons of improved dispersibility of the releasing agent.

Any wax may be used as the main chain of the modified wax as long as it can be modified with the vinyl polymer moiety by, for example, grafting. Polyolefin wax, especially thermal degradation polyolefin wax, is suitably used. Examples of the olefin constituting the polyolefin wax include linear olefins and branched olefins, such as ethylene, propylene, 1-butene, isobutylene, 1-pentene, 1-haxene, 1-heptene, 1-dodecene, and 1-octadecene. The polyolefin wax may be (1) a homopolymer of an olefin, (2) a copolymer of olefins, (3) an oxidized product of (1) or (2) above, (4) a modified product of (1) or (2) above, and (5) a copolymer of an olefin with a copolymerizable monomer.

Specific examples of the olefin homopolymer or copolymer and oxidized product thereof include polyethylene, polypropylene, ethylene/propylene copolymers, ethylene/1-butene copolyemrs, propylene/1-hexene copolymers and oxidized products of these polymers and copolymers. Specific examples of the modified product of the olefin homopolymer and copolymer include adducts of a maleic acid compound (e.g. maleic anhydride, monomethyl maleate, monobutyl maleate or dimethyl maleate) with the above olefin homopolymers and copolymers. Specific examples of copolymer of an olefin with a copolymerizable monomer include copolymers of an olefin with an unsaturated carboxylic acid (e.g. acrylic acid, methacrylic acid, itaconic acid or maleic anhydride) or an alkyl ester of an unsaturated carboxylic acid (e.g. C1 to C18 alkyl acrylate, methacrylate and maleate). It is not necessary that the polyolefin wax should be prepared from an olefin monomer. Polymethylene (sazol wax) may also be used for the purpose of the present invention.

Above all, the use of an olefin homopolymer or copolymer or an oxidized or modified product thereof is especially preferred. Illustrative of particularly suitable polyolefin waxes are polyethylene, polymethylene, polypropylene, ethylene/propylene copolymer, oxidized polyethylene, oxidized polypropylene and maleic acid compound-modified polypropylene. Polyethylene and polypropylene are most preferred.

The polyolefin wax generally has a softening point of 70 to 150° C., preferably 80 to 130° C., more preferably 80 to 110° C. for reasons of suitable fluidity of the toner particles and improved dispersibility of the releasing agent in the binder resin. The polyolefin wax generally has a number average molecular weight of 500 to 20,000, preferably 1,000 to 15,000, more preferably 1,500 to 10,000 and a weight average molecular weight of 800 to 100,000, preferably 1,500 to 60,000, more preferably 2,000 to 30,000, for reasons of prevention of filming on carrier particles, etc. and improved dispersibility of the releasing agent in the binder resin. The polyolefin wax generally has a needle penetration degree of 5 or less, preferably 3.5 or less, more preferably 1.0 or less. Any vinyl polymer may be used as the vinyl polymer moiety of the modified wax as long as it has an ester group content of 8–30%, preferably 10–25%, more preferably 12–20%, based on the weight of the vinyl polymer moiety.

The vinyl polymer contains an ester group containing vinyl monomer component. Examples of the ester group containing vinyl monomer include alkyl esters of an unsaturated carboxylic acid and vinyl ester of a carboxylic acid. The alkyl is preferably a lower alkyl having 1–8 carbon atoms, preferably 1–5 carbon atoms. The unsaturated carboxylic acid may be, for example, acrylic acid or methacrylic acid. Specific examples of the lower alkyl esters of an unsaturated carboxylic acid include methyl acrylate, methyl methacrylate, ethyl acrylate, ethyl methacrylate, butyl acrylate, butyl methacrylate, 2-ethylhexyl acrylate and 2-ethylhexyl methacrylate. Specific examples of the vinyl ester of a carboxylic acid include vinyl acetate. The use of C1–C5 alkyl ester of acrylic acid or methacrylic acid is especially preferred.

The vinyl polymer generally contains an ester group-free vinyl monomer capable of copolymerizable with the above ester group containing vinyl monomer in an amount so that the vinyl polymer moiety has an ester group content of 8 to 30% by weight. An aromatic vinyl monomer is suitably used. Illustrative of suitable aromatic vinyl monomer are styrene and its homologues such as o-methylstyrene, m-methylstyrene, p-methylstyrene, α-methylstyrene, p-ethylstyrene, p-methoxystyrene, p-hydroxystyrene, p-acetoxystyrene, vinyltoluene, ethylstyrene, phenylstyrene and benzylstyrene. Above all, styrene is especially preferably used.

The vinyl polymer generally has a number average molecular weight of 1,500 to 100,000, preferably 2,500 to 50,000, more preferably 2,800 to 20,000, and a weight average molecular weight of 5,000 to 200,000, preferably 6,000 to 100,000, more preferably 7,000 to 50,000. The glass transition temperature of the vinyl polymer is generally 40 to 90° C., preferably 45 to 80° C., more preferably 50 to 70° C., for reasons of good preservability and low temperature fixability of the toner.

The term "ester group content" as used herein is defined by the following equation:

$$CE=\Sigma[(44/Mi)\times Wi]$$

wherein

CE: Ester group content (% by weight),

Mi: Molecular weight of ester group-containing monomer, and

Wi: Amount (% by weight) of the ester group-containing monomer used for producing the vinyl polymer on the basis of a total weight of monomers used.

For example, when the vinyl polymer is produced from W1 g of a first ester group-containing monomer having a molecular weight of M1, W2 g of a second ester group-containing monomer having a molecular weight of M2, and W3 g of an ester group-free monomer having a molecular weight of M3, the ester group content CE (%) of the vinyl polymer is calculated as follows:

$$CE=[\{(44/M1)\times W1/(W1+W2+W3)\}+\{(44/M2)\times W2/(W1+W2+W3)\}]\times 100.$$

Because of the presence of the modified wax containing a wax moiety which is compatible with the releasing agent and an ester group-containing vinyl polymer moiety which is compatible with the non-linear and linear resins, the binder resin has suitable compatibility with the releasing agent so that the releasing agent in the toner particle has a uniform small dispersion diameter. When the wax is used as a simple mixture with the vinyl polymer rather than in the form modified by the vinyl polymer, the releasing agent is present separately from the binder resin in the toner particle and has a large, non-uniform dispersion diameter.

The weight ratio of the wax moiety to the vinyl polymer moiety of the modified wax is preferably in the range of 1:100 to 45:100, more preferably 5:100 to 25:100, for reasons of attainment of suitable dispersibility of the releasing agent in the binder resin.

The modified wax may be prepared by reacting a wax with a vinyl monomer in the presence of a peroxide. Although not wishing to be bound by the theory, the modification mechanism would be as follows. The peroxide first attacks the straight chain of the wax to cause dehydrogenation. To the dehydrogenated cites of the wax, the vinyl monomer is grafted by radical polymerization to form vinyl polymer side chains. Because of the structure of the wax modified with the ester-containing vinyl polymer, the releasing agent may be surrounded by the vinyl polymer-modified wax which in turn is dispersed like islands in a matrix (sea) of the non-linear and linear resins.

The amount of the modified wax relative to the releasing agent is preferably such that the vinyl polymer-modified wax may be dispersed like islands in a matrix (sea) of the non-linear and linear resins with the releasing agent being contained in the vinyl polymer-modified wax. Preferably, the weight ratio of the modified wax to the releasing agent is 1:2 to 3:1. When the weight ratio is within the above range, the releasing agent with a small dispersion diameter can be suitably dispersed in the binder resin while maintaining the desired low temperature fixability and heat resistant preservability.

The modified wax is generally present in an amount of 3 to 20 parts by weight per 100 parts by weight of the binder resin.

One example of a method of producing the modified wax is as follows. A wax such as a polyolefin wax is dissolved or dispersed in a solvent such as toluene or xylene. The solution or dispersion is heated to 100 to 200° C., to which a solvent solution containing ester-containing vinyl monomer, an ester group-free vinyl monomer and a peroxide initiator (e.g. benzoyl peroxide, di-t-butylperoxide or t-butylperoxide benzoate) is added dropwise. From the reaction mixture, the solvent is removed to give a modified wax. The amount of the peroxide is generally 0.2 to 10% by weight, preferably 0.5 to 5% by weight, based on the total weight of the monomers. The amount of the wax in the modified wax is generally 1 to 30% by weight, preferably 5 to 25% by weight, based on a total weight of the wax and the vinyl polymer.

The product obtained by the above modifying reaction may contain unreacted wax and a free vinyl polymer which is not linked to the wax. It is not necessary, however, to remove such unreacted wax and free vinyl polymer from the product. The crude product as such may be used for the purpose of the present invention as the modified wax.

Any suitable known releasing agent may be used for the purpose of the present invention. Examples of the releasing agent include carnauba waxes, montan waxes, oxidized rice waxes, synthetic ester waxes, solid silicone varnishes, higher fatty acids, higher alcohols, montan ester waxes and low molecular weight polypropylene waxes. These waxes may be used alone or in combination. For reasons of both good low temperature fixability and high hot offset resistance, the use of polyolefin waxes, carnauba waxes, montan waxes, oxidized rice waxes and synthetic ester waxes is preferred. Microcrystalline carnauba waxes having an acid value not greater than 5 mgKOH/g are preferable. Carnauba waxes which are subjected to a treatment in which free fatty acids are removed therefrom are also be suitably used. Montan waxes are montan type waxes prepared by refining minerals. Montan waxes having microcrystals, and an acid value of from 5 to 14 mgKOH/g are preferably used. Oxidized rice waxes can be prepared by air-oxidizing rice bran oils. The acid value of oxidized waxes is preferably from 10 to 30 mgKOH/g. Synthetic ester waxes may be prepared by reaction of a monofunctional straight chain fatty acid and a monofunctional straight chain alcohol. Polyolefin waxes are those described above with respect to modified wax.

The amount of the releasing agent in the toner is from 1 to 15 parts by weight, preferably from 2 to 10 parts by weight, per 100 parts by weight of the binder resin included in the toner for reasons of providing suitable amount of the releasing agent on a fixing roller during fixation of toner images, and thereby attaining satisfactory anti-filming property and offset resistance.

The dispersion diameter of the releasing agent and the amount of the releasing agent fed to the fixing roller during fixation can be also controlled by the kneading conditions, such as shear force applied to the toner composition during kneading, the kneading time and the kneading temperature, and by the diameter of the raw material releasing agent prior to kneading. The raw material releasing agent generally has a volume average particle diameter of 10 $\mu$m to 1 mm, preferably 10 to 800 $\mu$m, more preferably 20 to 500 $\mu$m. The volume average particle diameter herein is measured by laser diffraction/scattering grain size distribution measuring device (LA-920 manufactured by Horiba Manufacturing Co., Ltd.).

It is preferred that the raw material releasing agent have a circularity of at least 0.67 for reasons of uniformity of dispersion diameter thereof when kneaded and dispersed in the binder resin. The circularity is a value calculated by the equation:

$$\text{Circularity}=S/L^2\times 4/\pi$$

wherein L represents a maximum length of a diameter of the releasing agent, and S represents a projected area of the releasing agent. The circularity herein is determined by a method in which samples are magnified using a reflection type scanning electron microscope or an optical microscope. The image information is then inputted into an image analyzer (Luzex III produced by Nireco Corp.) to calculate the circularity according to the above equation. As the circularity becomes nearer to 1, the shape of the releasing agent becomes closer to true sphere.

The spherical releasing agent may be produced by a melt spray method in which a melt of the releasing agent at 100 to 200° C. is sprayed through a small nozzle for instantaneous solidification. The particle diameter may be controlled by the diameter of the nozzle and the temperature of the melt. Even when the raw material releasing agent is spheres, the shape of the releasing agent dispersed in the binder resin is not necessarily spherical. The shape of the releasing agent contained in the toner is not specifically limited.

It is preferred that the non-linear resin, linear resin, modified wax and releasing agent have SP values satisfying the following relationship:

$$SP4<SP3<SP1<SP2;$$

$$0.2<(SP1-SP3)<1;\text{ and}$$

$$0.8<(SP1-SP4)$$

wherein SP1, SP2, SP3 and SP4 represent the SP values of the non-linear resin, linear resin, modified wax and releasing agent, respectively.

The SP value (solubility parameter δ) is defined by the following formula in the Hilderbrand-Scatchard solution theory:

$$\delta=(\Delta E/V)^{1/2}$$

wherein ΔE represents the molar heat of evaporation, V represents the molar volume and ΔE/V represents cohesive energy density. Generally, a change of heat quantity ΔHm caused by mixing is expressed by:

$$\Delta Hm=V(\delta 1-\delta 2)\cdot\Phi 1/\Phi 2$$

where δ1 represents an SP value of the solvent, δ2 represents an SP value of the solute, Φ1 represents a volume fraction of the solvent and Φ2 represents a volume fraction of the solute. The closer is δ1 to δ2, the smaller becomes the heat quantity ΔHm and the smaller becomes the Gibbs free energy. Thus, compatibility increases as the difference in SP value decreases.

The SP value of a resin may be determined from the SP value of a solvent in which the resin is most soluble. When the monomer composition of a given resin is known, the SP value of the resin may be calculated from the monomer composition using the method of Fedor (Polym. Eng. Sci., 14[2] (1974) according to the following formula:

$$SP\text{ value}=(\Sigma\Delta ei/\Sigma\Delta vi)^{1/2}$$

wherein Δei represents the atomic or atomic group heat of evaporation and Δvi represents the atomic or atomic group volume.

The releasing property of the releasing agent varies according to the state in which the releasing agent is dispersed in the binder resin. The releasing agent which is very compatible with the binder resin fails to melt at a temperature corresponding to the inherent melting point thereof and, therefore, fails to exhibit the desired releasing property. It is thus important that the releasing agent be present in discrete domains dispersed in the matrix of the binder resin in order to obtain desired releasing property. It is therefore advantageous that the releasing agent be not compatible with the binder resin. This is so, especially when the toner is produced by a method including kneading and pulverization. The dispersion diameter of the releasing agent is determined in the kneading step for kneading the releasing agent together with other toner ingredients such as the binder resin. When the compatibility of the releasing agent with the binder resin is low, dispersibility of the releasing agent in the binder resin is low and, therefore, the dispersion diameter of the releasing agent becomes large. A large dispersion diameter is advantageous from the standpoint of anti-offset property, because the amount of the releasing agent present in the vicinity of the surface of the toner particles is large and, therefore, the amount of the releasing agent exuded from the toner particles is large. However, from the standpoint of anti-filming and fluidity of the toner, too large a dispersion diameter is disadvantageous. When the non-linear resin, linear resin, modified wax and releasing agent have SP values satisfying the above-described relationship, the compatibility between the non-linear resin, linear resin, modified wax and releasing agent becomes very suited for exhibiting both anti-filming property and anti-offset property.

If desired, a resin other than the above-mentioned resins may be used as a binder resin in combination with the above-mentioned resins, as long as it does not deteriorate the desired characteristics of the toner. Specific examples of such additional resin include polyurethane resins, silicone resins, ketone resins, petroleum resins and hydrogenated petroleum resins. These resins can be used alone or in combination. The method for manufacturing these resins is not particularly limited, and any known polymerization methods such as bulk polymerization, solution polymerization, emulsion polymerization, and suspension polymerization can be used.

The toner of the present invention preferably contains a metal compound of salicylic acid, the metal having at least 3 valence for reasons of improved resistance to hot offset. The salicylic acid metal compound may be a complex or a salt and is used in an amount of from 0.05 to 10 parts by weight per 100 parts by weight of the binder resin.

The salicylic acid metal compound for use in the present invention has the following formula:

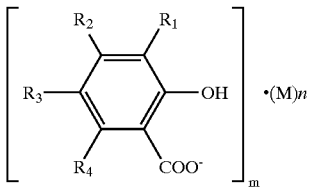

wherein $R_1$, $R_2$, $R_3$ and $R_4$ independently represent a hydrogen atom, an alkyl group having 1 to 18 carbon atoms or an allyl group, wherein $R_1$ and $R_2$, $R_2$ and $R_3$, or $R_3$ and $R_4$ optionally share a bond connectivity to form an aromatic or aliphatic group optionally having a substituent; M represents a metal; and m is an integer not less than 3 and n is an integer not less than 2. All metals having a valence of at least 3 can be used as the center metal M. Among the metals, Fe, Ni, Al, Ti, and Zr are preferable, and Fe is the most preferable in view of safety. The use of the salicylic acid metal compound in conjunction with the non-linear resin having a hydroxyl value of at least 20 mgKOH/g is especially preferable, because of improved hot offset resistance. Probably, the salicylic acid metal compound can bond to the non-linear resin to form cross-linkages.

It is preferred that the binder resin have tetrahydrofuran solubles having such a molecular weight distribution according to gel permeation chromatography that at least one peak having a half value width of not greater than 15,000 is present in a molecular weight region of 1,000 to 10,000 for reasons of improved heat sensitivity and low temperature fixability.

In the present specification, the molecular weight distribution of a resin is measured by gel permeation chromatorgraphy (GPC). The gel permeation chromatography is performed as follows: A column is stabilized in a chamber heated to 40° C., through which THF is allowed to flow at a flowing speed of 1 ml/min. Then, 50 to 200 $\mu$l of a THF solution of a sample to be measured having a concentration of from 0.05 to 0.6% by weight, is injected into the column with a syringe having a tip end to which a filter unit is connected. Elution is then started to determine the molecular distribution of the sample. Similar operations are performed with respect to several standard polystyrene resins, which have different molecular weights and each of which has a single molecular weight, to prepare a calibration curve. It is preferable to use at least about ten standard polystyrenes to prepare the calibration curve. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes. As a detector, RI is used.

It is also preferred that the toner have chloroform insolubles in an amount of 5 to 40% by weight based on the weight of the binder resin for reasons of attainment of improved hot offset resistance without adversely affecting the low temperature fixability.

The "chloroform insolubles" as used herein is measured as follows.

A sample toner (amount W1 (about 1.0 g)) is mixed with about 50 g of chloroform and the mixture is allowed to quiescently stand at 20° C. for 24 hours to dissolve soluble matters. The resulting mixture is centrifuged and filtered using a type 5C filter according to JIS (P3801). The filtrate is then vacuum-dried to leave a residue. The weight W2 of the residue (toluene soluble resin component) is measured. The weights of the toluene soluble and toluene insoluble components other the resin component are measured by thermal analysis such as DSC-TG and thermogravimetry and are defined as W3 and T4, respectively. The toluene insoluble content (% by weight) is calculated according to the following equation:

$$\text{Toluene insolubles}=(W1-W2-W3)/(W1-W3-W4)\times100$$

Specific examples of the colorant include known dyes and pigments such as carbon black, lamp black, iron black, Aniline Blue, Phthalocyanine Blue, Phthalocyanine Green, Hansa Yellow G, Rhodamine 6C Lake, chalco-oil blue, Chrome Yellow, quinacridone, Benzidine Yellow, Rose Bengale and triarylmethane. These dyes and pigments can be used alone or in combination. The toner of the present invention can be used as a black toner or a multi- or full color toner. The content of the colorant in the toner is from 1 to 30% by weight, and preferably from 3 to 20% by weight, based on the total resin components in the toner.

The toner of the present invention may additionally contain one or more additives such as a magnetic material, a charge controlling agent and an external additive, if desired.

By including a magnetic material in the toner of the present invention, the toner can be used as a magnetic toner. Specific examples of the magnetic materials include iron oxides such as magnetite, hematite and ferrite; metals such as iron, cobalt and nickel; metal alloys of iron, cobalt or nickel with one or more of metals such as aluminum, copper, lead, magnesium, tin, zinc, antimony, beryllium, bismuth, cadmium, calcium, manganese, selenium, titanium, tungsten and vanadium; and mixture of these materials. When these ferromagnetic materials are included in the toner of the present invention, the average particle diameter thereof is preferably from 0.1 to 1 $\mu$m, more preferably 0.2 to 0.4 $\mu$m.

The content thereof in the toner is from about 20 to about 200 parts by weight, and preferably from 40 to 150 parts by weight, per 100 parts by weight of the binder resin.

Suitable charge controlling agents for use in the toner of the present invention include known polarity controlling agents such as Nigrosine dyes, metal complex dyes and quaternary ammonium salts. The polarity controlling agents can be used alone or in combination. Suitable negative charge controlling agents include metal complexes of monoazo dyes, salicylic acid and dicarboxylic acids. The content of such polarity controlling agents in the toner is from 0.1 to 10 parts by weight, and preferably from 1 to 5 parts by weight, per 100 parts by weight of the binder resin.

In the toner of the present invention, known inorganic fillers can be added as an external additive to the toner particles. Specific examples of the inorganic fillers for use as the external additive include silica, titanium oxide, silicon carbide, alumina and barium titanate. It is preferable to add at least two different inorganic fillers. The amount of the external additive is 0.1 to 5 parts by weight, preferably 0.5 to 2 parts by weight, per 100 parts by weight of the toner particles. It is preferred that the toner of the present invention provide a coefficient of static friction of at least 0.20, more preferably at least 0.25, most preferably at least 0.30 to 0.35, when press-molded into a plate for reasons of long service life and improved resistance to filming.

In general, a releasing agent has a low friction coefficient. The larger the amount of the releasing agent exposed on the surface of toner particles, the lower is the friction coefficient of the surface of the toner. When an external additive of a toner, which serves as a spacer (i.e., covers the surface of the toner), is embedded in the toner due to physical stresses, the surface of the toner particles are exposed (i.e., the releasing agent is present on the surface of the toner), and thereby the friction coefficient of the surface of the toner particles lowers. When the friction coefficient of a toner is measured after the toner has been molded into a plate upon application of pressure, the toner is subjected to mechanical and heat stresses, which are similar to the stresses which the toner is subjected in an image forming apparatus. Therefore, the releasing agent included in the toner tends to separate from the toner, resulting in migration of the releasing agent to the surface of the toner. Namely, the lower the friction coefficient of the toner plate, the more the amount of the releasing agent present on the surface of the toner. Therefore, by performing this measurement, it can be determined whether the toner is stable when repeatedly used.

The friction coefficient of a toner including a releasing agent depends on the amount of the releasing agent exposed on the surface of the toner and the adhesion conditions of the external additive during the preparation of the toner. The amount of releasing agent present on the surface of the toner varies depending upon the dispersion diameter of the releasing agent attained by the kneading and upon pulverization conditions under which the kneaded and solidified toner composition is ground. In general, releasing agents are more brittle than binder resins. Therefore, when a kneaded toner block including a releasing agent is pulverized, the toner block tends to be divided at the releasing agent portion. Thus, the releasing agent tends to be exposed on the surface of the resultant toner particles. In addition, the releasing agent tends to be present as fine particles in the toner. Accordingly, by reducing the interface at which kneaded and solidified toner composition is divided during pulverization (by changing the addition amount of the releasing agent, the particle diameter of the raw material releasing agent added, compatibility of binder resins used, and kneading conditions such as shear strength applied during the kneading step), the amount of the releasing agent exposed on the toner particles can be decreased. In addition, since the friction coefficient of external additives is generally greater than that of releasing agents, the friction coefficient of a toner can be controlled by changing the coverage of the toner with an external additive and the adhesion conditions of the external additive.

The coefficient of static friction of the toner is measured as follows.

Three (3) grams of a toner sample are included in a pellet forming die and pressed for 1 minute by application of a load of 6 tons to form a plate-shaped toner pellet having a diameter of 40 mm. The coefficient of static friction of the surface of the pellet is measured with an automatic friction/abrasion analyzer (DFPM-SS manufactured by Kyowa Interface Science Co., Ltd.) by a point contact method using a stainless steel ball as a contact member at a load of 50 g with a stroke of 10 mm.

It is also preferred that the toner have such a particle diameter distribution that the weight average particle diameter ranges from 4 to 7.5 $\mu$m, more preferably 5 to 7 $\mu$m and that 60 to 80% by number, more preferably 65 to 75% by number, thereof has a particle diameter of 5 $\mu$m or less for reasons of high quality image (precise and high resolution) as well as improved anti-filming property and long service life.

The particle diameter distribution of the toner is measured with a Coulter Multisizer II (manufactured by Coulter Electronics, Inc.) to which an interface (manufactured by Nikkaki Inc.) capable of outputting number-based and volume-based distribution and a personal computer (PC9801 manufactured by NEC Inc.) are connected. As an electrolytic solution for measurement, an aqueous 1% by weight NaCl solution of first-grade sodium chloride is used. A dispersant (0.5–5 ml of a salt of alkylbenzenesulfonic acid) is added to 10 to 15 ml of the above electrolytic solution, to which 2 to 20 mg of a sample to be measured are added. The resulting mixture is subjected to a dispersing treatment for about 1–3 minute to about 3 minutes in an ultrasonic dispersing machine. The electrolytic solution (100–200 ml) is taken in another vessel, to which a predetermined amount of the dispersed sample is added. Using an aperture of 100 $\mu$m in the above particle size distribution measuring device, the particle size distribution is measured on the basis of the particle number with the Coulter counter for 30,000 particles having a diameter in the range of 2–40 $\mu$m. The number and volume particle distribution are calculated. The weight average diameter of the toner is determined from that volume distribution.

It is also preferred that the toner have a content of particles having a circle-equivalent diameter of not smaller than 0.60 $\mu$m but smaller than 3 $\mu$m of 25% or less, more preferably 15% or less for reasons of improved anti-filming property, prevention of reduction of image density and prevention of occurrence of non-uniformity of image density. Probably, super-fine toner particles having a circle-equivalent diameter of less than 3 $\mu$m fail to establish a high coulomb force which is greater than the Van der Waals force and which is sufficient to move the toner to electrostatic latent images on a photoconductor and, therefore, tend to accumulate in the developer without being used for the development of the latent electrostatic images. It is further preferred that the toner have a circularity of 0.91 to 0.96, more preferably 0.93 to 0.96, for reasons of prevention of transfer failure of an toner image to an image receiving member, improved efficiency to be removed from a photoconductor in a cleaning zone and improved service life.

The "content of toner particles having a circle-equivalent diameter of not smaller than 0.60 μm but less than 3 μm" and the "sphericity" as used herein is measured using a flow particle image analyzer, "FPIA-2100", manufactured by SYSMEX Co., Ltd.). A 1% NaCl aqueous solution (50 to 100 ml) after being passed through a 0.45 μm filter is mixed with 0.1 to 5 ml of a surfactant (preferably a salt of alkylbenzenesulfonate). To the resulting solution, 1 to 10 mg of a sample is added. This is subjected to a dispersion treatment for 1 minute with an ultrasonic disperser to form a sample dispersion liquid having a concentration of 5000 to 15000 particles/μl. The sample dispersion liquid is measured for the average sphericity of particles having a circle-equivalent diameter of not smaller than 0.60 μm using the above flow type particle image analyzer. From the area of the two-dimensional image of each of the particles measured with a CCD camera, a diameter of a circle having the same area is calculated as a circle-equivalent diameter of the particle. The average sphericity is calculated by dividing a sum of the circle-equivalent diameters of the particles by the number of the particles as follows.

$$\text{Average sphericity}=\Sigma(L_0/L)/n$$

wherein $L_0$ represents a spherical length of a circle having the same area as the projected area of a toner particle and L represents a peripheral length of the projected image of the toner particle. The sphericity provides an index for evaluating the shape of a toner particle. The closer the shape of the toner to a true circle, the nearer becomes the sphericity to 1. As the shape becomes complicated, the sphericity becomes smaller.

The foregoing description has been made on the toner of the present invention produced by a kneading and pulverization method. In such a method, a mixture containing ingredients of the toner including the above-described binder resin, colorant and releasing agent is kneaded with a kneader, such as a heat roll kneader. The kneaded mixture is solidified and ground into a suitable diameter. The particle size distribution of the ground toner may be controlled by suitably adjusting the feed rate of the material to be ground, the pressure and feed rate of high pressure air supplied to the grinding machine (when a pulverizer having a jet impact pulverizing section is used as described hereinafter), the shape of a collision plate (when a pulverizer having a jet impact pulverizing section is used as described hereinafter) and conditions in which the ground particles are air-classified, such as the position at which air is fed to the classifier, the direction along which air flows and the pressure of an exhaust blower.

The toner according to the present invention may also be prepared by any other suitable method such as a polymerization method. Examples of the polymerization method include (a) an emulsion method in which a radical polymerizable monomer composition containing a chain transfer agent is subjected to emulsion polymerization in an aqueous medium using a water soluble polymerization initiator to form resin particles which are fuse bonded into particles in an aqueous medium; (b) a suspension polymerization method in which a radical polymerizable monomer composition containing a colorant and a chain transfer agent is subjected to suspension polymerization in an aqueous medium; (c) a dissolution suspension method; (d) a polycondensation method in which a toner composition containing at least a polyester resin, a colorant and a releasing agent is dissolved or dispersed in an organic solvent, the resulting solution or dispersion being added to an aqueous medium to form particles while undergoing polycondensation. The method (a) is disclosed in, for example, Japanese Laid Open Patent Publications No. S60-220358 and No.H05-303231; the method (b) is disclosed in, for example, Japanese Laid Open Patent Publications No. S59-028164 and No. S59-152447; the method (c) is disclosed in, for example, Japanese Laid Open Patent Publications No. H10-020549 and No. H11-024308); and the method (d) is disclosed in, for example, Japanese Laid Open Patent Publication No. 2002-169336, the disclosure of which is hereby incorporated by reference herein. A blend of the toner particles obtained by the above methods may also be used for the purpose of the present invention. Among the above polymerization methods, the method (d) is particularly preferably used for the preparation of the toner of the present invention, because the wax is hardly exposed on the surfaces of the toner particles and because the molecular weight control of the polyester resin is easy.

The toner according to the present invention may be suitably used together with a carrier as a two-component developer. Any suitable carrier customarily used in the field of image forming devices may be used for the purpose of the present invention. Examples of the carrier include magnetic powders such as iron powders, ferrite powders and nickel powders; glass beads; and surface coated products thereof. Suitable resins useful for coating carriers include styrene-acrylic copolymers, silicone resins, maleic acid resins, fluorine-containing resins, polyester resins, epoxy resins, etc. When styrene-acrylic copolymers are used, the styrene content is preferably from 30 to 90% by weight. When the fraction of styrene is less than 30% by weight, the resultant developer has poor developing properties. In contrast, when the fraction is greater than 90% by weight, the coated film is hard and therefore tends to be easily peeled from the carrier material, resulting in shortening of life of the carrier. When a carrier is coated with a resin, one or more additives such as adhesion imparting agents, hardeners, lubricants, electroconductive agents, and charge controlling agents may be added to the resin.

Description will now be made of a method of forming an image with reference to FIG. 2 which is a schematic view illustrating a construction of an electrophotographic apparatus suitable for carrying out the method according to the present invention.

Figure 2:
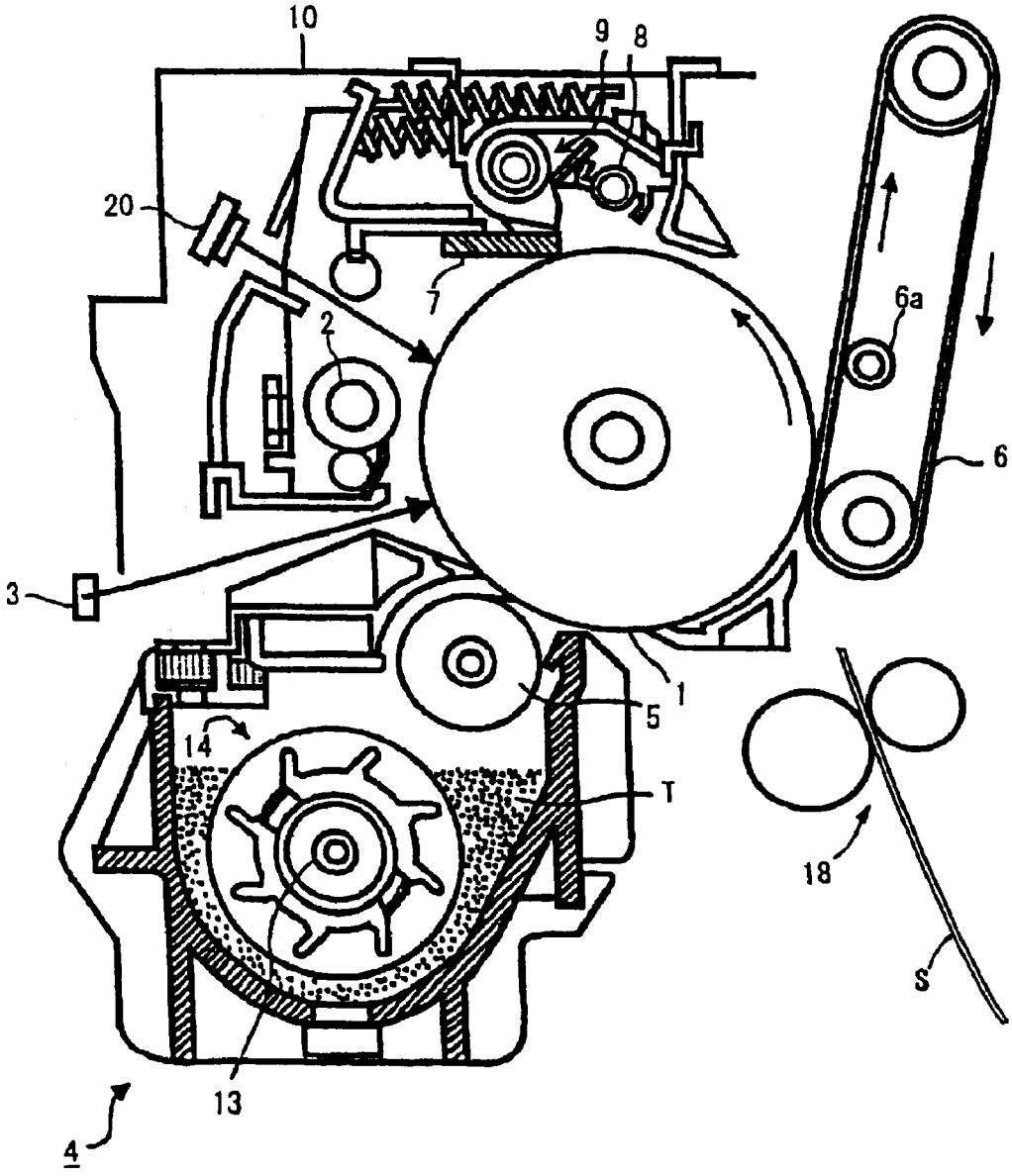
FIG. 2 is a cross-sectional view diagrammatically illustrating an image forming apparatus used to carry out an image forming method according to the present invention.

In the electrophotographic apparatus of FIG. 2, a cylindrically shaped photoconductor or photoreceptor 1 as an image bearing member is supported so as to rotate in the direction (counterclockwise) indicated by an arrow. Arranged around the photoreceptor 1, are a charging roller 2, an exposing device 3, a developing device 4, a transfer belt 6, a cleaning blade 7, a rotary blade 8, and a toner returning coil 9. The above-described elements except the transfer belt 6 are housed in a photoreceptor/cleaning unit 10.

The developing device 4 is housed in a case having an opening in which a developing sleeve 5 is rotatably supported and disposed opposite the surface of the photoreceptor 1. A paddle 14 is rotatably supported and disposed in the case at the position opposite the developing sleeve 5. In the paddle 14, a screw conveyor 13 is provided and supported such that the screw conveyor 13 rotates in the same direction as the paddle 14.

The thus constructed electrophotographic apparatus operates as follows. After the photoreceptor 1 is uniformly charged by the charging roller 2, the exposing device 3 exposes the surface of the photoreceptor 1 to form an electrostatic latent image on the photoreceptor 1. In the developing device 4, a two-component developer T is contained. The two-component developer T is a mixture of a carrier and a toner according to the present invention. When the developer T is agitated by the paddle 14, the toner is charged by friction. The developer T including the charged toner is attracted to the developing sleeve 5 and is conveyed as the developing sleeve 5 rotates. Subsequently, the toner on the developing sleeve 5 is transferred to the surface of the photoreceptor 1 at the position where the developing sleeve 5 faces the photoreceptor 1 so that the electrostatic latent image on the photoreceptor 1 is developed with toner to form a toner image on the photoreceptor 1. A voltage of opposite polarity to that of toner is applied to the transfer belt 6 through a bias roller 6*a* by a power source (not shown). A transfer sheet S is supplied from a feeding device (not shown) and is fed by resist rollers 18 to a transfer station (nip) between the photoreceptor 1 and the transfer belt 6, where the toner image on the photoreceptor 1 is transferred to the transfer sheet S by an electric field generated at the transfer station. Subsequently, the transfer sheet with the toner image is conveyed to a fixing device (not shown) by the transfer belt 6. The toner image is fused on the transfer sheet while passing through the fixing device. The toner which is not transferred to the transfer sheet and remains on the photoreceptor 1 is removed by the cleaning blade 7 and is then guided to the toner returning coil 9 by the rotary blade 8. Subsequently, the toner is returned to the developing device 4 as a recycled toner by the toner returning coil 9. Charges on the photoreceptor 1 cleaned by the cleaning blade 7 are removed by a lamp 20.

The following examples will further illustrate the present invention. Parts are by weight.

Preparation of Non-Linear Resin (1)

Ten (10) moles of fumaric acid, 4 moles of trimellitic acid, 6 moles of bisphenol A-(2,2)propylene oxide and 4 moles of bisphenol A-(2,2)ethylene oxide were placed in a flask equipped with a stainless steel agitator, a condenser, a nitrogen gas feed tube and a thermometer. The mixture was heated at 200° C. under a nitrogen gas flow with stirring to perform a condensation polymerization reaction, thereby obtaining a non-linear polyester resin (1) having an acid value of 16.3 mgKOH/g, a hydroxyl value of 35.1 mgKOH/g, softening point of 145.1° C., a glass transition temperature of 61.5° C., an SP value of 11.2, a main peak at 4,000 in a molecular weight distribution and a half value width of the main peak of 10,000.

Preparation of Linear Polyester Resin (1)

Eight (8) moles of terephthalic acid, 6 moles of bisphenol A-(2,2)propylene oxide and 4 moles of bisphenol A-(2,2) ethylene oxide were placed in a flask equipped with a stainless steel agitator, a reflux condenser, a nitrogen gas feed tube and a thermometer. The mixture was heated at 220° C. under a nitrogen gas flow with stirring to perform a condensation polymerization reaction, thereby obtaining a linear polyester resin (1) having an acid value of 2.1 mgKOH/g, a hydroxyl value of 34 mgKOH/g, a softening point of 100.8° C., a glass transition temperature of 60.3° C., an SP value of 10.7, a main peak at 6,000 in a molecular weight distribution and a half value width of the main peak of 22,000.

Preparation of Hybrid Resin (1)

Twenty (20) moles of styrene and 5 moles of butyl methacrylate, serving as addition polymerization monomers, and 0.4 mole of t-butylhydroperoxide, serving as a polymerization initiator, were charged in a dropping funnel. On the other hand, 10 moles of fumaric acid, serving as a double-reactive monomer capable of undergoing addition-polymerization and condensation-polymerization, 4 moles of trimellitic anhydride, 6 moles of bisphenol A-(2,2) propylene oxide and 4 moles of bisphenol A-(2,2)ethylene oxide, serving as condensation-polymerizable monomers, and 60 moles of dibutyltinoxide, serving as an esterifying agent, were placed in a flask equipped with a stainless steel agitator, a condenser, a nitrogen gas feed tube and a thermometer. While maintaining the contents in the flask at 135° C. under a nitrogen gas flow with stirring, the mixture in the dropping funnel was added dropwise into the flask through 5 hours. Thereafter, the resulting mixture in the flask was further maintained at 135° C. for 6 hours. Then, the mixture was further reacted at 220° C. to obtain a hybrid resin (1) having an acid value of 24.5 mgKOH/g, a hydroxyl value of 25.1 mgKOH/g, a softening point of 113.5° C. and a glass transition temperature of 59.5° C.

The above-mentioned polymerization of each of the non-linear polyester resin (1), linear polyester resin (1) and hybrid resin (1) was performed while the polymerization degree of each polymer was monitored by a method in which the softening point of the reaction product was measured according to ASTM E28-67. When the reaction product had a predetermined softening point, the polymerization reaction was stopped. Then the reaction product was cooled and pulverized to obtain the desired polymer having the predetermined properties.

The acid value and hydroxyl value of the above resins are measured by methods according to JIS K0070.

Preparation of Modified Wax (1)

In an autoclave equipped with a thermometer and an agitator, 150 parts of a low molecular weight polyethylene (Sanwax LEL-400 manufactured by Sanyo Chemical Industries, Ltd.; softening point: 128° C.) were dissolved in 450 parts of xylene. After air in the autoclave had been replaced by nitrogen gas, a solution containing 594 parts of styrene, 255 parts of methyl methacryate, 34.3 parts of di-t-butylperoxyhexahydroterephthalate and 120 parts of xylene was added dropwise in the autoclave through 2 hours at 155° C. to perform a polymerization reaction, and the reaction mixture was further maintained at that temperature for 1 hour to complete the polymerization. The solvent was then removed by distillation to give a modified wax (1) having an ester content of 13.2% by weight, a number average molecular weight of 3,300, a weight average molecular weight of 12,000, a glass transition temperature of 65.2° C., an SP value of 10.1. The weight ratio of the wax moiety to the vinyl polymer moiety of the modified wax (1) was 0.18.

Preparation of Modified Wax (2)

In an autoclave equipped with a thermometer and an agitator, 150 parts of a carnauba wax (manufactured by Toa Chemical Co., Ltd.; softening point: 75° C.) were dissolved in 450 parts of xylene. After air in the autoclave had been replaced by nitrogen gas, a solution containing 594 parts of styrene, 255 parts of methyl methacryate, 34.3 parts of di-t-butylperoxyhexahydroterephthalate and 120 parts of xylene was added dropwise in the autoclave through 2 hours at 160° C. to perform a polymerization reaction, and the reaction mixture was further maintained at that temperature for 1 hour to complete the polymerization. The solvent was then removed by distillation to give a modified wax (2) having an ester content of 13.2% by weight, a number average molecular weight of 3,400, a weight average molecular weight of 12,300, a glass transition temperature of 64.8° C., an SP value of 10.1. The weight ratio of the wax moiety to the vinyl polymer moiety of the modified wax (2) was 0.18.

Preparation of Modified Wax (3)

In an autoclave equipped with a thermometer and an agitator, 200 parts of a low molecular weight polyethylene (Sanwax LEL-400 manufactured by Sanyo Chemical Industries, Ltd.; softening point: 128° C.) were dissolved in 450 parts of xylene. After air in the autoclave had been replaced by nitrogen gas, a solution containing 600 parts of styrene, 200 parts of butyl acryate, 16.1 parts of di-t-butylperoxyhexahydroterephthalate and 120 parts of xylene was added dropwise in the autoclave through 2 hours at 155° C. to perform a polymerization reaction, and the reaction mixture was further maintained at that temperature for 1 hour to complete the polymerization. The solvent was then removed by distillation to give a modified wax (3) having an ester content of 8.5% by weight, a number average molecular weight of 5,300, a weight average molecular weight of 18,500, a glass transition temperature of 52.0° C., an SP value of 10.0. The weight ratio of the wax moiety to the vinyl polymer moiety of the modified wax (3) was 0.25.

Preparation of Modified Wax (4)

In an autoclave equipped with a thermometer and an agitator, 200 parts of a low molecular weight polyethylene (Biscol 440P manufactured by Sanyo. Chemical Industries, Ltd.; softening point: 153° C.) were dissolved in 450 parts of xylene. After air in the autoclave had been replaced by nitrogen gas, a solution containing 280 parts of styrene, 520 parts of methyl methacryate, 32.3 parts of di-t-butylperoxyhexahydroterephthalate and 120 parts of xylene was added dropwise in the autoclave through 2 hours at 150° C. to perform a polymerization reaction, and the reaction mixture was further maintained at that temperature for 1 hour to complete the polymerization. The solvent was then removed by distillation to give a modified wax (4) having an ester content of 28.6% by weight, a number average molecular weight of 3,300, a weight average molecular weight of 16,000, a glass transition temperature of 58.8° C., an SP value of 9.7. The weight ratio of the wax moiety to the vinyl polymer moiety of the modified wax (4) was 0.25.

Preparation of Modified Wax (5)

In an autoclave equipped with a thermometer and an agitator, 150 parts of a low molecular weight polyethylene (Biscol 440P manufactured by Sanyo Chemical Industries, Ltd.; softening point: 153° C.) were dissolved in 400 parts of xylene. After air in the autoclave had been replaced by nitrogen gas, a solution containing 665 parts of styrene, 185 parts of butyl acryate, 8.5 parts of di-t-butylperoxyhexahydroterephthalate and 120 parts of xylene was added dropwise in the autoclave through 2 hours at 160° C. to perform a polymerization reaction, and the reaction mixture was further maintained at that temperature for 1 hour to complete the polymerization. The solvent was then removed by distillation to give a modified wax (5) having an ester content of 7.49% by weight, a number average molecular weight of 8,300, a weight average molecular weight of 22,900, a glass transition temperature of 60.5° C., an SP value of 10.0. The weight ratio of the wax moiety to the vinyl polymer moiety of the modified wax (5) was 0.18.

Preparation of Modified Wax (6)

In an autoclave equipped with a thermometer and an agitator, 200 parts of a low molecular weight polyethylene (Biscol 440P manufactured by Sanyo Chemical Industries, Ltd.; softening point: 153° C.) were dissolved in 450 parts of xylene. After air in the autoclave had been replaced by nitrogen gas, a solution containing 200 parts of styrene, 600 parts of methyl methacryate, 32.3 parts of di-t-butylperoxyhexahydroterephthalate and 120 parts of xylene was added dropwise in the autoclave through 2 hours at 150° C. to perform a polymerization reaction, and the reaction mixture was further maintained at that temperature for 1 hour to complete the polymerization. The solvent was then removed by distillation to give a modified wax (6) having an ester content of 33.0% by weight, a number average molecular weight of 3,200, a weight average molecular weight of 17,000, a glass transition temperature of 55.3° C., an SP value of 9.7. The weight ratio of the wax moiety to the vinyl polymer moiety of the modified wax (6) was 0.25.

Preparation of Vinyl Polymer (1)

In an autoclave equipped with a thermometer and an agitator, 450 parts of xylene were charged. After air in the autoclave had been replaced by nitrogen gas, a solution containing 700 parts of styrene, 300 parts of methyl methacryate, 34.3 parts of di-t-butylperoxyhexahydroterephthalate and 120 parts of xylene was added dropwise in the autoclave through 2 hours at 155° C. to perform a polymerization reaction, and the reaction mixture was further maintained at that temperature for 1 hour to complete the polymerization. The solvent was then removed by distillation to give a vinyl polymer (1) having an ester content of 13.2% by weight, a number average molecular weight of 3,500, a weight average molecular weight of 9,100, a glass transition temperature of 68.8° C., an SP value of 10.4. The vinyl polymer (1) did not contain a wax moiety.

Preparation of Toner

Toners were prepared using the thus produced non-linear polyester resin (1), linear polyester resin (1), hybrid resin (1), modified waxes (1) to (6) and vinyl polymer (1).

EXAMPLE 1

| | |
|---|---|
| Non-linear polyester resin (1) | 50 parts |
| Linear polyester resin (1) | 50 parts |
| Modified wax (1) | 5 parts |
| Releasing agent (low molecular weight polyethylene; particle size: 600 μm; circularity: 0.85; SP value: 8.5) | 4.5 parts |
| Carbon black (#44 manufactured by Mitsubishi Chemical Corporation) | 8 parts |
| Charge controlling agent (3,5-di-t-butylsalicylic acid Zn (II) complex) | 3 parts |

The above composition was thoroughly mixed using Henschel mixer and the mixture was kneaded at 130° C. for about 30 minutes using a roll mill. The kneaded mixture was cooled and coarsely pulverized with a hammer mill to into particles of 200 to 400 μm sizes. The coarsely pulverized particles were then finely ground using a pulverizer ("Model IDS" manufactured by Nippon Pneumatic Mfg. Co., Ltd.) to give mother toner particles. The pulverizer had a jet impact pulverizing section in which particles carried by compressed air were collided at a high speed against a stationary collision plate, and an air classifying section in which the finely pulverized particles from the pulverizing section were swirled and air-classified. FIG. 1 is a schematic illustration of a TEM pattern (cross-sectional photograph taken using a transmission electron microscope (TEM)) of one of the mother toner particles obtained above. The vinyl polymer-modified wax and the polyester resins formed discrete domains from each other. Namely, the vinyl polymer-modified wax was dispersed like islands in a matrix (sea) of the polyester resins with the releasing agent (wax particles) being surrounded by the vinyl polymer-modified wax. The number of the islands ranges from 5 to 50 and the diameters (major axes) of the islands were uniform and ranged from 0.5 to 1 μm.

The mother toner particles (100 parts) were mixed 0.6 part of hydrophobic silica (R972 manufactured by Japan Aerosil Inc.; average diameter of primary particles: 0.016 μm) and 0.2 part of hydrophobic titanium oxide (T805 manufactured by Japan Aerosil Inc.; average diameter of primary particles: 0.02 μm) in a Henschel mixer, thereby obtaining a toner No. 1.

The toner No. 1 was subjected to DSC analysis for the determination of peak molecular weight and half value width of THF soluble matter thereof. Further, the toner No. 1 was measured for the chloroform insolubles (gel content), particle size distribution (using Coulter counter and a flow particle image analyzer) and coefficient of static friction when press-molded into a plate. The results are summarized in Table 1. In Table 1, FPIA means a content (% by number) of particles having a circular-equivalent diameter of not smaller than 0.6 μm but smaller than 3 μm.

EXAMPLE 2

Example 1 was repeated in the same manner as described except that the modified wax (2) was substituted for the modified wax (1), thereby obtaining a toner No. 2 having physical properties shown in Table 1.

EXAMPLE 3

Example 1 was repeated in the same manner as described except that the modified wax (3) was substituted for the modified wax (1), thereby obtaining a toner No. 3 having physical properties shown in Table 1.

EXAMPLE 4

Example 1 was repeated in the same manner as described except that the modified wax (4) was substituted for the modified wax (1), thereby obtaining a toner No. 4 having physical properties shown in Table 1.

EXAMPLE 5

Example 1 was repeated in the same manner as described except that as the releasing agent carnauba wax (pulverization method; particle size: 600 μm; circularity: 0.54) was used in lieu of the low molecular weight polyethylene, thereby obtaining a toner No. 5 having physical properties shown in Table 1.

EXAMPLE 6

Example 1 was repeated in the same manner as described except that as the releasing agent carnauba wax (fusion spray method; particle size: 600 μm; circularity: 0.75; SP value: 8.6) was used in lieu of the low molecular weight polyethylene, thereby obtaining a toner No. 6 having physical properties shown in Table 1.

EXAMPLE 7

| | |
|---|---|
| Non-linear polyester resin (1) | 40 parts |
| Linear polyester resin (1) | 50 parts |
| Hybrid resin (1) | 10 parts |
| Modified wax (1) | 5 parts |
| Releasing agent (carnauba wax; fusion spray method; particle size: 600 μm; circularity: 0.75; SP value: 8.6) | 4.5 parts |

-continued

| | |
|---|---|
| Carbon black (#44 manufactured by Mitsubishi Chemical Corporation) | 8 parts |
| Charge controlling agent (3,5-di-t-butylsalicylic acid Zn (II) complex) | 3 parts |

Using the above composition, Example 1 was repeated in the same manner as described to obtain a toner No. 7 having physical properties shown in Table 1.

EXAMPLE 8

Example 7 was repeated in the same manner as described except that 3,5-di-t-butylsalicylic acid Fe(III) complex was substituted for 3,5-di-t-butylsalicylic acid Zn(II) complex, thereby obtaining a toner No. 8 having physical properties shown in Table 1.

EXAMPLE 9

Example 7 was repeated in the same manner as described except that the amounts of the non-linear polyester resin (1) and linear polyester resin (1) were changed to 35 parts and 65 parts, respectively, thereby obtaining a toner No. 9 having physical properties shown in Table 1.

EXAMPLES 10 AND 11

Example 9 was repeated in the same manner as described except that the feed rate of the coarse particles and the air injection speed were changed so that that the particle size distribution was changed as shown in Table 1. The thus obtained toner No. 10 and toner No. 11 had physical properties shown in Table 1.

COMPARATIVE EXAMPLE 1

Example 1 was repeated in the same manner as described except that the modified wax (5) was substituted for the modified wax (1), thereby obtaining a toner No. Comp. 1 having physical properties shown in Table 1.

COMPARATIVE EXAMPLE 2

Example 1 was repeated in the same manner as described except that the modified wax (6) was substituted for the modified wax (1), thereby obtaining a toner No. Comp. 2 having physical properties shown in Table 1.

COMPARATIVE EXAMPLE 3

Example 1 was repeated in the same manner as described except that the vinyl polymer (1) was substituted for the modified wax (1), thereby obtaining a toner No. Comp. 3 having physical properties shown in Table 1.

COMPARATIVE EXAMPLE 4

Example 1 was repeated in the same manner as described except that the amounts of the non-linear polyester resin (1) and linear polyester resin (1) were changed to 100 parts and 0 part, respectively (namely, the linear polyester resin was not used at all), thereby obtaining a toner No. Comp. 4 having physical properties shown in Table 1.

COMPARATIVE EXAMPLE 5

Example 1 was repeated in the same manner as described except that the amounts of the non-linear polyester resin (1)

and linear polyester resin (1) were changed to 0 part and 100 parts, respectively (namely, the non-linear polyester resin was not used at all), thereby obtaining a toner No. Comp. 5 having physical properties shown in Table 1.

COMPARATIVE EXAMPLE 6

Example 1 was repeated in the same manner as described except that the modified wax (1) was not used at all, thereby obtaining a toner No. Comp. 6 having physical properties shown in Table 1.

COMPARATIVE EXAMPLE 7

| | |
|---|---|
| Non-linear polyester resin (1) | 50 parts |
| Linear polyester resin (1) | 50 parts |
| Vinyl polymer (1) | 4.5 parts |
| Low molecular weight polyethylene (Sanwax LEL-400 manufactured by Sanyo Chemical Industries, Ltd.; softening point: 128° C.) | 0.5 part |
| Releasing agent (low molecular weight polyethylene; particle size: 600 μm; circularity: 0.85; SP value: 8.5) | 4.5 parts |
| Carbon black (#44 manufactured by Mitsubishi Chemical Corporation) | 8 parts |
| Charge controlling agent (3,5-di-t-butylsalicylic acid Zn (II) complex) | 3 parts |

Using the above composition, Example 1 was repeated in the same manner as described to obtain a toner No. Comp. 7 having physical properties shown in Table 1. The TEM analysis of the mother particle revealed that the releasing agent (wax particles) and the polyester resins formed discrete domains from each other. Namely, the releasing agent was dispersed like islands in a matrix (sea) of the polyester resins. The diameters (major axes) of the islands were not uniform and ranged from 0.2 to 3 μm.

TABLE 1

| | Molecular weight distribution | | Gel | Particle size distribution | | | coefficient of |
|---|---|---|---|---|---|---|---|
| Toner No. | peak | half value width | content (%) | volume average diameter (μm) | content of 5 μm > | FPIA (% by number) | static friction |
| 1 | 5000 | 16,000 | 15 | 9.0 | 30 | 10 | 0.39 |
| 2 | 5000 | 16,000 | 15 | 9.1 | 28 | 11 | 0.38 |
| 3 | 5000 | 16,000 | 15 | 9.2 | 27 | 10 | 0.35 |
| 4 | 5000 | 16,000 | 15 | 9.2 | 27 | 11 | 0.40 |
| 5 | 5000 | 16,000 | 15 | 9.0 | 30 | 12 | 0.36 |
| 6 | 5000 | 16,000 | 15 | 9.0 | 30 | 10 | 0.41 |
| 7 | 5000 | 16,000 | 15 | 8.9 | 32 | 10 | 0.42 |
| 8 | 5000 | 16,000 | 15 | 9.0 | 28 | 10 | 0.39 |
| 9 | 4700 | 14,200 | 15 | 9.2 | 27 | 11 | 0.39 |
| 10 | 4700 | 14,200 | 15 | 7.0 | 65 | 26 | 0.32 |
| 11 | 4700 | 14,200 | 15 | 6.9 | 68 | 15 | 0.32 |
| Comp. 1 | 5000 | 16,000 | 15 | 9.0 | 30 | 10 | 0.30 |
| Comp. 2 | 5000 | 16,000 | 15 | 9.2 | 28 | 10 | 0.29 |
| Comp. 3 | 5000 | 16,000 | 15 | 9.1 | 29 | 11 | 0.32 |
| Comp. 4 | 6000 | 22,000 | 0 | 9.0 | 31 | 10 | 0.28 |
| Comp. 5 | 4000 | 10,000 | 42 | 9.2 | 27 | 10 | 0.29 |
| Comp. 6 | 5000 | 16,000 | 15 | 9.1 | 30 | 11 | 0.19 |

TABLE 1-continued

| | Molecular weight distribution | | Gel | Particle size distribution | | | coefficient of |
|---|---|---|---|---|---|---|---|
| Toner No. | peak | half value width | content (%) | volume average diameter (μm) | content of 5 μm > | FPIA (% by number) | static friction |
| Comp. 7 | 5000 | 16,000 | 15 | 9.1 | 29 | 11 | 0.30 |

Preparation of Developers

The following components were mixed for 20 minutes using a homomixer to prepare a coating liquid.

| | |
|---|---|
| Silicone resin (organo straight silicone) | 100 parts |
| Toluene | 100 parts |
| γ-(2-aminoethyl) aminopropyl-trimethoxysilane | 5 parts |
| Carbon black | 10 parts |

Then, 1000 parts of particulate spherical magnetite having a particle diameter of 50 μm were coated with the above coating liquid using a fluidized bed type coating apparatus to obtain a magnetic carrier (1).

Four (4) parts of each of the toner No. 1 to Toner No. 11 and toner No. Comp. 1 to toner No. Comp. 7 was mixed with 96 parts of the carrier (1) to prepare developer No. 1 to developer No. 11 and developer No. Comp. 1 to developer No. Comp. 7, respectively.

Evaluation

Each of the thus obtained developers was tested for the fixability (low temperature fixability and hot offset resistance), anti-filming property, background stains, high temperature preservability, fine line reproducibility and uniformity of image density according to the methods shown below. The results are shown in Table 2.

(1) Fixability:

The developer is set in a copying machine (Model MF 4550 manufactured by Ricoh Company, Ltd.) having a fixing unit modified to install a Teflon-coated roller as a fixing roller. Copies are produced using copy paper (Type 6200 manufactured by Ricoh Company, Ltd.) while changing the fixing temperature of the fixing roller to determine the cold offset temperature (i.e., a minimum fixing temperature below which cold offset occurs) and hot offset temperature (i.e., a maximum fixing temperature above which hot offset occurs). Thus, the low temperature fixability and hot offset resistance of the toner are evaluated. The fixing conditions for the evaluation of the low temperature fixability are as follows:

Paper feeding speed: 140 mm/sec

Pressure of fixing roller: 1.2 Kgf/cm$^2$

Nip width of the fixing area: 3 mm while the fixing conditions for the evaluation of the hot offset resistance are as follows:

Paper feeding speed: 50 mm/sec

Pressure of fixing roller: 2.0 Kgf/cm$^2$

Nip width of the fixing area: 4.5 mm

The low temperature fixability is evaluated according to the following ratings:

A: the minimum fixing temperature is lower than 125° C.

B: the minimum fixing temperature is not lower than 125° C. but lower than 135° C.

C: the minimum fixing temperature is not lower than 135° C. but lower than 145° C.

D: the minimum fixing temperature is not lower than 145° C. but lower than 155° C.

E: the minimum fixing temperature is at least 155° C.

The hot offset resistance is evaluated according to the following ratings:

A: the maximum fixing temperature is at least 200° C.

B: the maximum fixing temperature is not lower than 190° C. but lower than 200° C.

C: the maximum fixing temperature is not lower than 180° C. but lower than 190° C.

D: the maximum fixing temperature is not lower than 170° C. but lower than 180° C.

E: the maximum fixing temperature is lower than 170° C.

The results of the evaluation are summarized in Table 2.

(2) Anti-Filming Property

Each of the toners and its developer are set in a filming-evaluating copying machine, a modified IMAGIO MF-4550 manufactured by Ricoh Company, Ltd. whose developing unit is modified. A A4 size chart having a plurality of alternately arranged white and solid patterns each having a width of 1 cm is repeatedly reproduced to obtain 100,000 copies. After the production of the 20,000th image, 50,000th image and 100,000th image, occurrence of filming is determined by the following method. Copy papers of A3 size, which has been stored for 2 hours at 30° C. under 90% relative humidity, are set in the copying machine. A half tone image formed of 1 dot image (1 dot×1 dot) is outputted. The image density of the darkest portion in the half tone image in the area corresponding to the solid pattern and the image density of the lightest portion in the area corresponding to the white pattern are measured with a Macbeth densitometer to determine the difference of the image densities. The filming is evaluated according to the following ratings.

A: density difference is not greater than 0.05

B: density difference is from 0.06 to 0.10

C: density difference is from 0.11 to 0.25

D: density difference is from 0.26 to 0.40

E: density difference is not less than 0.41

When no filming occurs, there is no difference in image densities. Filming becomes more significant as the density difference increases. As the number of copied images increases, filming occurs more frequently.

(3) High Temperature Preservability

Twenty (20) grams of a toner sample is placed in a glass container having a volume of 20 ml. The glass container containing the toner sample is allowed to stand in a thermostatic chamber at 60° C. for 4 hours. Then, needle penetration degree of the solidified toner is measured using a needle penetration tester according to JIS K2235-1991. The high temperature preservability is evaluated according to the following ratings:

A: penetration is 10 mm or more

B: penetration is from 5.0 to 9.9 mm

C: penetration is from 3.0 to 4.9 mm

D: penetration is from 0 to 2.9 mm (4) Background Stains (Fog)

The developer is set in a copying machine (Model MF 4550 manufactured by Ricoh Company, Ltd.) having a charger of a roller type and a cleaning blade provided for sliding contact with a photoconductor. A A4 size chart having a plurality of alternately arranged white and solid patterns each having a width of 1 cm is repeatedly reproduced to obtain 100,000 copies. Thereafter, a white image is reproduced on A-3 size paper. The densities of arbitral six points of the white image are measured with McBeath densitometer, from which an average of these six image densities is calculated. A difference between the average image density and the image density of the paper which does not pass the copy machine is then determined. The occurrence of background stains is evaluated according to the following ratings:

A: density difference is not greater than 0.02

B: density difference is from 0.03 to 0.05

C: density difference is from 0.06 to 0.08

D: density difference is from 0.09 to 0.11

E: density difference is not less than 0.12

When there is no difference, no background stains occur.

As the difference increases, background stains occur more significantly.

(5) Reproducibility of Fine Lines

The developer is set in a copying machine similar to that used in above background stains test. A A4 size chart having a plurality of alternately arranged white and solid patterns is repeatedly reproduced to obtain 100,000 copies. Thereafter, line patterns of equally space apart vertical and horizontal lines having densities of 2.0, 2.2, 2.5, 2.8, 3.2, 3.6, 4.0, 4.5, 5.0, 5.6, 6.3 and 7.1 lines/mm are reproduced. The fine line reproducibility is represented in terms of the highest line density image produced with satisfactory resolution and is evaluated according to the following ratings.

A: lines having a density of from 6.3 to 7.1 lines/mm can be reproduced

B: lines having a density of from 5.0 to 5.6 lines/mm can be reproduce

C: lines having a density of from 4.0 to 4.5 lines/mm can be reproduced

D: lines having a density of from 2.8 to 3.6 lines/mm can be reproduced

E: lines having a density of from 2.0 to 2.5 lines/mm can be reproduced (6) Uniformity of Image Density The developer is set in a copying machine similar to that used in above background stains test. A A4 size chart having a plurality of alternately arranged white and solid patterns each having a width of 1 cm is repeatedly reproduced to obtain 100,000 copies. Thereafter, an alternately arranged white-and-black image (half tone image; 2 dots×2 dots; 600 dpi) is outputted on a A3 size paper. The image density of the darkest portion in the half tone image in the area corresponding to the solid pattern and the image density of the lightest portion in the area corresponding to the white pattern are measured with a Macbeth densitometer to determine the difference of the image densities. Uniformity of the image density is evaluated according to the following ratings.

A: density difference is not greater than 0.01

B: density difference is from 0.02 to 0.05

C: density difference is from 0.06 to 0.10

D: density difference is from 0.11 to 0.20

E: density difference is not less than 0.21

TABLE 2

| Developer No. | Low Temperature Fixability | Hot Offset Resistance | Anti-filming Property $2 \times 10^4$th | $5 \times 10^4$th | $10^5$th | High Temperature Preservability | Background Stains | Reproducibility of Fine Lines | Uniformity of Image Density |
|---|---|---|---|---|---|---|---|---|---|
| 1 | B | B | A | A | B | B | B | B | A |
| 2 | B | B | A | A | A | B | B | B | A |
| 3 | B | B | A | B | B | B | B | B | A |
| 4 | B | B | A | A | A | B | B | B | A |
| 5 | B | A to B | A | A | A | B | B | B | A |
| 6 | B | B | A | A | A | A | B | B | A |
| 7 | B | B | A | A | A | A | A | B | A |
| 8 | B | A | A | A | B | A | A | B | A |
| 9 | A | A | A | A | B | A | A | B | A |
| 10 | A | A | A | A | B | A | A | A | B |
| 11 | A | A | A | A | B | A | A | A | A |
| Comp. 1 | B | B | B | B | D | C | D | B | C |
| Comp. 2 | B | D | A | A | B | B | D | B | C |
| Comp. 3 | B | D | B | B | D | C | E | B | D |
| Comp. 4 | E | A | B | B | D | B | C | B | C |
| Comp. 5 | A | E | B | B | D | D | C | B | C |
| Comp. 6 | B | B | B | D | E | B | E | B | D |
| Comp. 7 | B | C | B | B | D | C | E | B | D |

What is claimed is:

1. A toner for developing an electrostatic latent image, comprising a colorant, a releasing agent and a binder resin, wherein said binder resin comprises a first, non-linear resin, a second, linear resin, and a modified wax comprising a wax moiety and a vinyl polymer moiety having an ester group content of 8 to 30% by weight based on the weight of the vinyl polymer moiety, and the weight ratio of said wax moiety to said vinyl polymer moiety is in the range of 1:100 to 45:100.

2. A toner as claimed in claim 1, wherein said modified wax is present in an amount of 3 to 20 parts by weight per 100 parts by weight of said binder resin.

3. A toner as claimed in claim 1, wherein said releasing agent is selected from the group consisting of carnauba wax, montan wax, polyolefin wax, oxidized rice wax and synthetic polyester wax.

4. A toner as claimed in claim 1, wherein said releasing agent is present in an amount of 2 to 10 parts by weight per 100 parts by weight of said binder resin.

5. A toner as claimed in claim 1, wherein the weight ratio of said modified wax to said releasing agent ranges from 1:2 to 3:1.

6. A toner as claimed in claim 1, wherein said first resin, said second resin, said modified wax and said releasing agent have solubility parameter (SP) values of SP1, SP2, SP3 and SP4, respectively, and wherein SP1, SP2, SP3and SP4 have the following relationship:

$$SP4<SP3<SP1<SP2;$$

$$0.2<(SP1-SP3)<1; \text{ and}$$

$$0.8<(SP1-SP4).$$

7. A toner as claimed in claim 1, wherein said wax moiety comprises a polyolefin.

8. A toner as claimed in claim 1, wherein said vinyl polymer moiety has a glass transition temperature of 40 to 90° C.

9. A toner as claimed in claim 1, wherein said first resin has an acid value of 20 to 70 mg KOH/g.

10. A toner as claimed in claim 1, wherein said second resin has an acid value of 7 to 70 mg KOH/g.

11. A toner as claimed in claim 1, further comprising a metal compound of salicylic acid, said metal having at least 3 valence.

12. A toner as claimed in claim 11, wherein said salicylic acid metal compound is present in an amount of from 0.05 to 10 parts by weight per 100 parts by weight of said binder resin.

13. A toner as claimed in claim 1, wherein said first resin has a hydroxyl value of at least 20 mg KOH/g.

14. A toner as claimed in claim 1, wherein said binder resin comprises one or more tetrahydrofuran solubles having a molecular weight distribution according to gel permeation chromatography wherein at least one peak having a half value width of not greater than 15,000 is present in a molecular weight region of 1,000 to 10,000.

15. A toner as claimed in claim 1, wherein said toner has one or more chloroform insolubles in an amount of 5 to 40 % by weight based on the weight of said binder resin.

16. A toner as claimed in claim 1, having a coefficient of static friction of at least 0.20 when press-molded into a plate.

17. A toner as claimed in claim 1, wherein the toner is in the form of one or more particles and the weight average particle diameter ranges from 4 to 7.5 μm and 60 to 80% by number thereof has a particle diameter of 5 μm or less.

18. A toner as claimed in claim 1, wherein the toner is in the form of one or more particles having a circle-equivalent diameter of not smaller than 0.60 μm but smaller than 3 μm of 25% or less.

19. A toner as claimed in claim 1, wherein the toner is in the form of one or more particles having circularity of 0.91 to 0.96.

20. A toner as claimed in claim 1, wherein said modified wax forms one or more domains dispersed in a matrix of said first and second resins with said releasing agent being comprised in said modified wax domains.

21. A toner as claimed in claim 1, wherein each of said first and second resins comprises at least 50 mole % of ester units, based on a total moles of the monomer units comprising respective non-linear resin and linear resins.

22. A toner cartridge comprising said toner according to claim 1.

23. A two-component developer comprising said toner according to claim 1, and a carrier.

24. A cartridge comprising said two-component developer according to claim 23.

25. A toner as claimed in claim 1, wherein said wax moiety has a number average molecular weight of 500 to 20,000 and said vinyl polymer moiety has a number average molecular weight of 1,590 to 100,000.

26. A process for forming an image, said process comprising developing an electrostatic latent image on a latent image-bearing member with said toner according to claim 1.

27. A toner for developing an electrostatic latent image, comprising a colorant a releasing agent and a binder resin, wherein said binder resin comprises a first, non-linear resin, a second, linear resin, and a modified wax comprising a wax moiety and a vinyl polymer moiety having an ester group content of 8 to 30% by weight based on the weight of the vinyl polymer moiety, and said binder resin further comprises a third, hybrid resin comprising a first polymer unit obtainable by condensation polymerization, and a second polymer unit connected to said first polymer unit and obtainable by addition polymerization.

28. A toner as claimed in claim 27, wherein each of said first resin, second resin and third resin comprises a polyester unit.

29. A toner as claimed in claim 27, wherein said first resin, second resin and third resin have softening points of TM1, TM2 and TM3, respectively, and glass transition temperatures TG1, TG2 and TG3, respectively, and wherein TM1, TM2, TM3, TG1 and TG2 satisfy the following relationship:

$$TM1 > TM3 > TM2$$

$$-10^\circ\ C. < (TG1 - TG2) < 10^\circ\ C.$$

$$30^\circ\ C. \leqq (TM1 - TM2) \leqq 60^\circ\ C.$$

* * * * *